US010087604B2

(12) United States Patent
Sasaoka

(10) Patent No.: US 10,087,604 B2
(45) Date of Patent: Oct. 2, 2018

(54) HYDRAULIC CIRCUIT FOR LOADER

(71) Applicant: Nabtesco Corporation, Tokyo (JP)

(72) Inventor: Mayu Sasaoka, Hyogo (JP)

(73) Assignee: Nabtesco Corporation, Tokyo (JP)

( * ) Notice: Subject to any disclaimer, the term of this patent is extended or adjusted under 35 U.S.C. 154(b) by 529 days.

(21) Appl. No.: 14/597,964

(22) Filed: Jan. 15, 2015

(65) Prior Publication Data

US 2015/0211211 A1 Jul. 30, 2015

(30) Foreign Application Priority Data

Jan. 29, 2014 (JP) ..... 2014-014106

(51) Int. Cl.
*E02F 9/22* (2006.01)
*E02F 3/42* (2006.01)
(Continued)

(52) U.S. Cl.
CPC ..... *E02F 9/2225* (2013.01); *E02F 3/42* (2013.01); *E02F 3/961* (2013.01); *E02F 9/2203* (2013.01);
(Continued)

(58) Field of Classification Search
CPC ..... F15B 11/161; F15B 11/162; F15B 11/165; F15B 11/166; F15B 11/167;
(Continued)

(56) References Cited

U.S. PATENT DOCUMENTS 5,413,452 A * 5/1995 Lech ..... E02F 9/2221 414/695.5
2010/0236233 A1 9/2010 Sumiyoshi et al.
(Continued)

FOREIGN PATENT DOCUMENTS

JP 2000-136803 A 5/2000
JP 2009-299852 A 12/2009
(Continued)

OTHER PUBLICATIONS

Notification of Reasons for Refusal issued in corresponding Japanese Application No. 2014-014106, dated Sep. 12, 2017 (8 pages).

*Primary Examiner* — F. Daniel Lopez
*Assistant Examiner* — Michael Quandt
(74) *Attorney, Agent, or Firm* — Osha Liang LLP

(57) ABSTRACT

An optional-attachment-operating direction switching valve is provided in a part of an unloading passage which part is on the upstream of an arm-operating direction switching valve and a bucket-operating direction switching valve. The hydraulic circuit is arranged such that the optional-attachment-operating direction switching valve receives pressure oil from a pressure oil supply passage which branches from the part of the unloading passage on the upstream of the optional-attachment-operating direction switching valve, the arm-operating direction switching valve receives pressure oil from a pressure oil supply passage which branches from a part of the unloading passage which part is between the optional-attachment-operating direction switching valve and the arm-operating direction switching valve, and the bucket-operating direction switching valve receives the pressure oil from a pressure oil supply passage which branches from a part of the unloading passage which part is between the optional-attachment-operating direction switching valve and the bucket-operating direction switching valve.

4 Claims, 3 Drawing Sheets

(51) Int. Cl.

| | |
|---|---|
| ***F15B 9/08*** | (2006.01) |
| ***E02F 3/96*** | (2006.01) |
| *F15B 11/16* | (2006.01) |

(52) U.S. Cl.
CPC ..... *E02F 9/2267* (2013.01); *F15B 9/08* (2013.01); *E02F 9/2282* (2013.01); *F15B 11/166* (2013.01); *F15B 2211/3059* (2013.01); *F15B 2211/30595* (2013.01); *F15B 2211/3116* (2013.01); *F15B 2211/35* (2013.01); *F15B 2211/7058* (2013.01); *F15B 2211/7135* (2013.01)

(58) Field of Classification Search
CPC .... F15B 2211/3116; F15B 2211/30595; E02F 9/2282
See application file for complete search history.

(56) References Cited

U.S. PATENT DOCUMENTS

| | | | | |
|---|---|---|---|---|
| 2011/0088798 | A1 | 4/2011 | Miki et al. | |
| 2011/0232787 | A1 | 9/2011 | Miki | |
| 2012/0233996 | A1* | 9/2012 | Quinnell ..... | E02F 9/2235 60/421 |

FOREIGN PATENT DOCUMENTS

| | | | |
|---|---|---|---|
| JP | 2010-270528 | A | 12/2010 |
| JP | 2011-208693 | A | 10/2011 |

* cited by examiner

HYDRAULIC CIRCUIT FOR LOADER

CROSS REFERENCE TO RELATED APPLICATION

The present application claims priority from Japanese Patent Application No. 2014-014106, which was filed on Jan. 29, 2014, the disclosure of which is herein incorporated by reference in its entirety.

BACKGROUND OF THE INVENTION

The present invention relates to a hydraulic circuit of a loader to which at least a bucket, an arm, and an optional attachment are attached.

A technology of this type is recited in Patent Literature 1 (Japanese Unexamined Patent Publication No. 2011-208693), for example. A hydraulic circuit of a loader recited in Patent Literature 1 is arranged in such a way that, in an unloading passage connected to a hydraulic pump, a boom-operating direction switching valve, a bucket-operating direction switching valve, and a service valve are provided in series in this order from the upstream. The boom-operating direction switching valve is a valve for operating a boom cylinder, whereas the bucket-operating direction switching valve is a valve for operating a bucket cylinder. The service valve is a valve for operating an optional cylinder.

SUMMARY OF THE INVENTION

The optional cylinder recited in Patent Literature 1 performs a reciprocal motion. Assume that, for example, a rotational attachment such as a rotary blade for mowing is attached to a loader as an optional attachment. In this case, the optional attachment actuator is not a cylinder performing a reciprocal motion but a hydraulic motor performing a rotational motion.

Assume further that the boom or the bucket is operated simultaneously with the rotary blade for mowing (optional attachment) in the loader arranged as above. In such a case, when the service valve is provided on the downstream of the boom-operating direction switching valve and the bucket-operating direction switching valve as in the hydraulic circuit recited in Patent Literature 1, pressure oil is more likely to flow into the boom-operating direction switching valve and/or the bucket-operating direction switching valve than to flow into the service valve.

With such a hydraulic circuit, while a skilled operator is able to adjust the rotation speed of the rotary blade, an operator who is not used to the operation may not be able to adjust the rotation speed of the rotary blade at will.

The present invention has been done to solve the problem above, aiming at providing a hydraulic circuit which is able to improve the operability of an optional attachment attached to a loader.

The present invention relates to a hydraulic circuit for a loader, including: an unloading passage connected to a hydraulic pump; an arm-operating direction switching valve configured to supply or exhaust, to or from an arm actuator, pressure oil from the hydraulic pump; a bucket-operating direction switching valve configured to supply or exhaust, to or from a bucket actuator, the pressure oil from the hydraulic pump; and an optional-attachment-operating direction switching valve configured to supply or exhaust, to or from an optional attachment actuator, the pressure oil from the hydraulic pump. In the arrangement above, the optional-attachment-operating direction switching valve is provided in a part of the unloading passage which part is on the upstream of the arm-operating direction switching valve and the bucket-operating direction switching valve. In the hydraulic circuit, furthermore, the optional-attachment-operating direction switching valve receives the pressure oil from an optional-attachment-operating pressure oil supply passage which branches from a part of the unloading passage which part is on the upstream of the optional-attachment-operating direction switching valve, the arm-operating direction switching valve receives the pressure oil from an arm-operating pressure oil supply passage which branches from a part of the unloading passage which part is between the optional-attachment-operating direction switching valve and the arm-operating direction switching valve, and the bucket-operating direction switching valve receives the pressure oil from a bucket-operating pressure oil supply passage which branches from a part of the unloading passage which part is between the optional-attachment-operating direction switching valve and the bucket-operating direction switching valve.

In the hydraulic circuit of the present invention, because the pressure oil is more likely to flow into the optional-attachment-operating direction switching valve than to flow into the arm-operating direction switching valve or the bucket-operating direction switching valve, the operation of the optional-attachment-operating direction switching valve is preferred to the operation of the arm-operating direction switching valve or the bucket-operating direction switching valve. This improves the operability of the optional attachment attached to the loader.

DESCRIPTION OF THE PREFERRED EMBODIMENTS

The following will describe an embodiment of the present invention with reference to figures.

(Circuit Diagram of Hydraulic Circuit)

Figure 1:
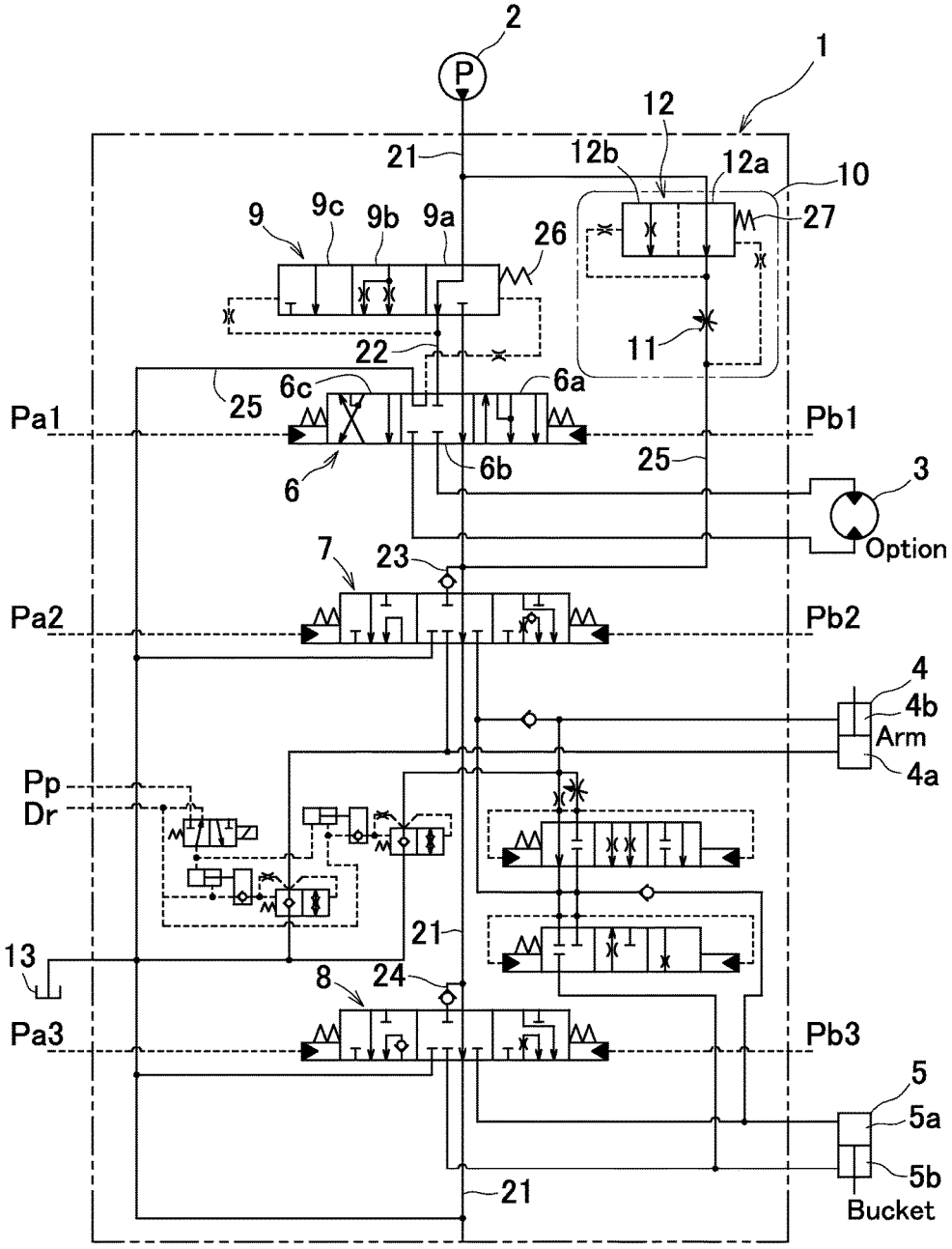
FIG. 1 is a hydraulic circuit diagram of a stack valve for a loader of an embodiment of the present invention.
Figure 2:
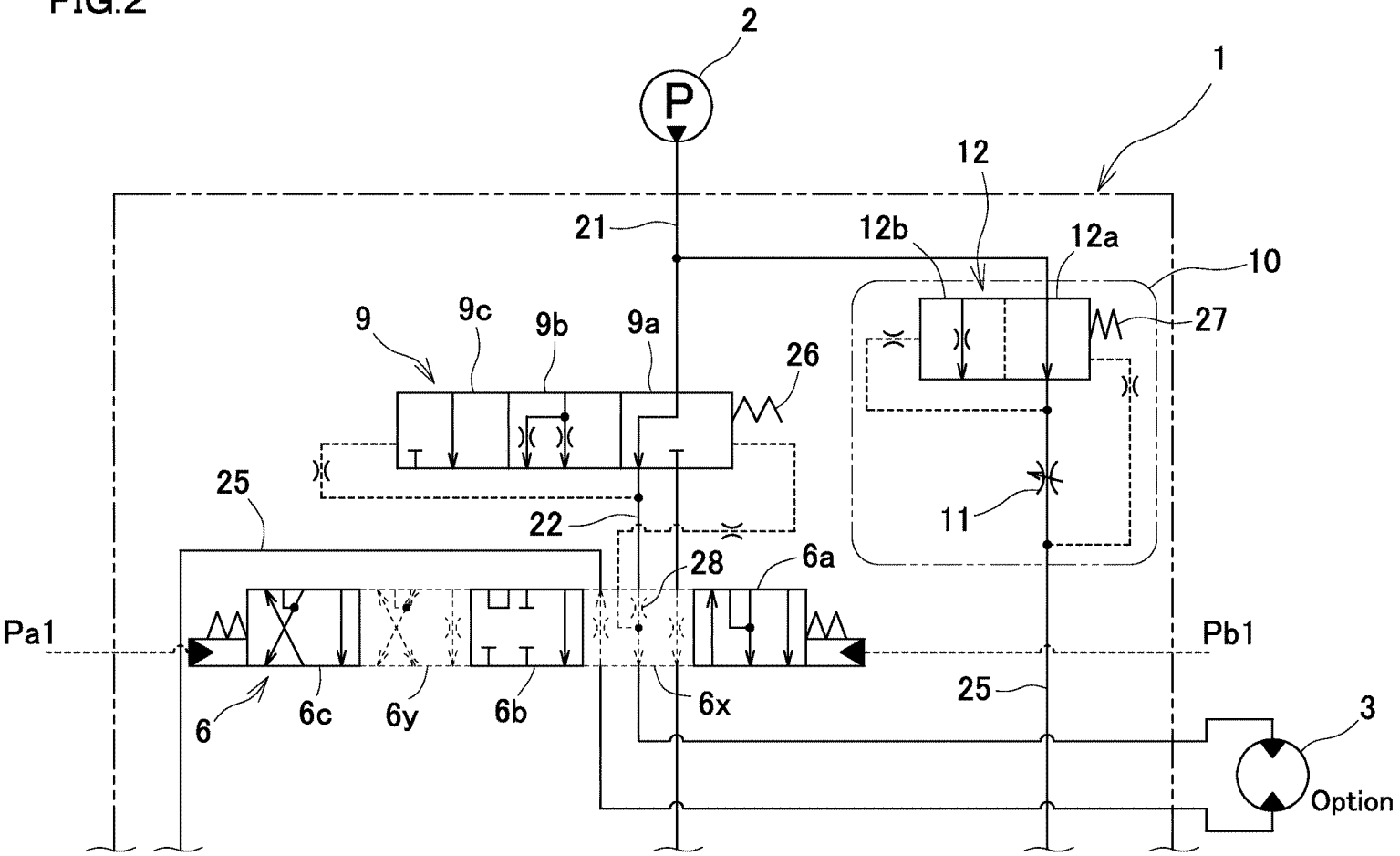
FIG. 2 is an enlarged view of an upper part of the hydraulic circuit shown in FIG. 1, in which the state of the middle stroke region of the spool of the optional-attachment-operating direction switching valve is indicated by dotted lines.
Figure 3:
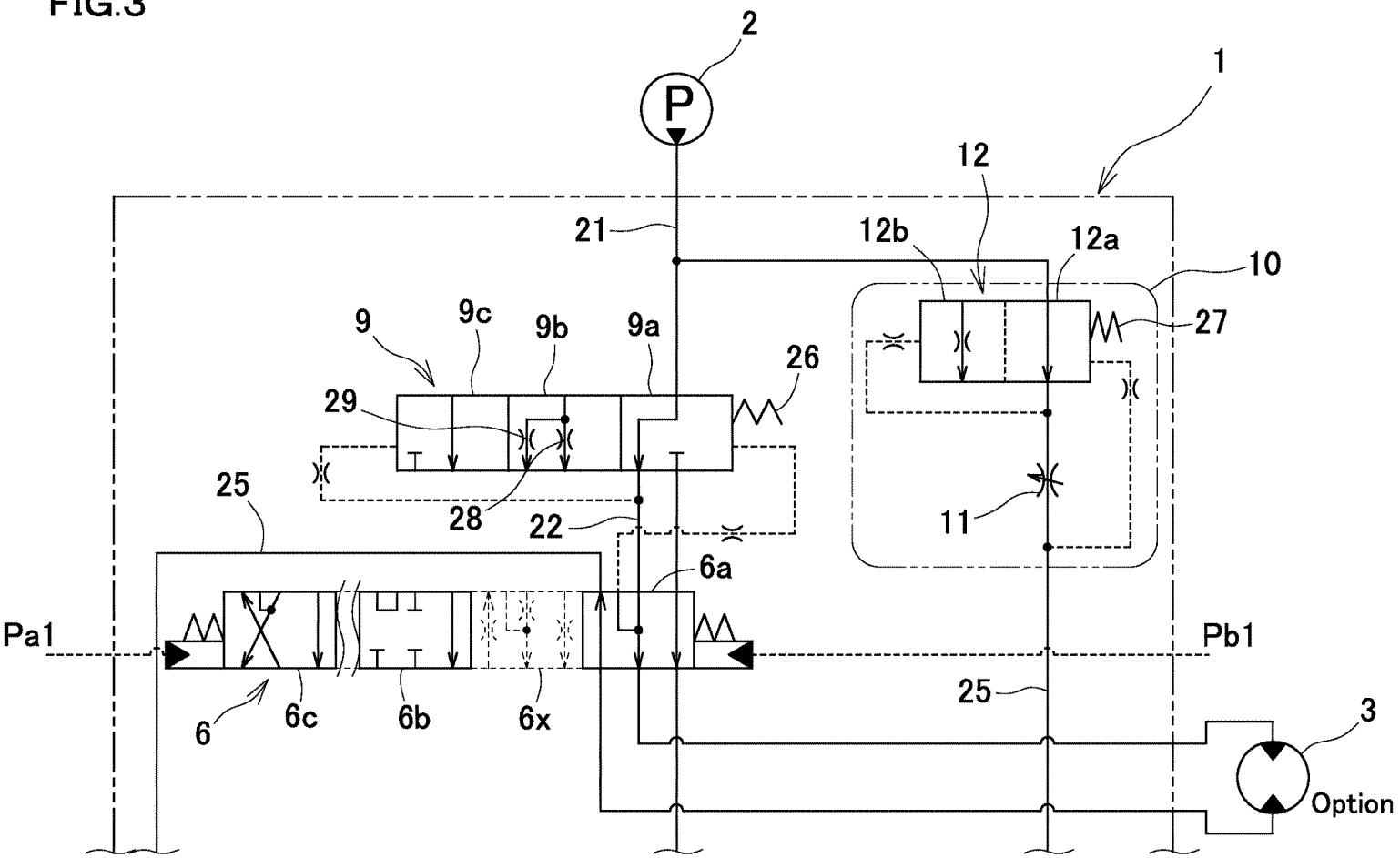
FIG. 3 is a hydraulic circuit diagram showing a state in which the spool of the optional-attachment-operating direction switching valve has been moved from the middle stroke region shown in FIG. 2 to the full stroke position.

Referring to FIGS. 1 to 3, a hydraulic circuit 1 of a stack valve for a loader of the embodiment of the present invention will be described. The hydraulic circuit 1 is a hydraulic circuit including direction switching valves 6, 7, and 8 which are provided in series in an unloading passage 21 which is connected to a hydraulic pump 2. This hydraulic circuit 1 shown in FIG. 1 may be understood as a stack valve including direction switching valves 6, 7, and 8 provided in series. In such a case, indicated by the reference numeral 1 is a stack valve.

The loader which is not illustrated is provided with attachments such as an arm attached to the front part of the loader main body and a bucket attached to the leading end portion of the arm. In addition to these attachments, an optional attachment is attached to the loader which employs the hydraulic circuit 1 of the present embodiment. Examples of the optional attachment includes a rotary blade for mowing and a drill. The explanation below presupposes that a rotary blade for mowing is attached to the loader as an optional attachment. The optional attachment is not limited to the rotary blade for mowing and the drill.

The arm which is not illustrated is moved by an arm cylinder 4 (arm actuator). The arm moves up as pressure oil is supplied to a head-side chamber 4*a* of the arm cylinder 4, and moves down as the pressure oil is supplied to a rod-side chamber 4*b*. The bucket is moved by a bucket cylinder 5 (bucket actuator). The bucket performs a dumping action (forward tilting) as the pressure oil is supplied to a head-side chamber 5*a* of the bucket cylinder 5, and performs a scooping action (backward tilting) as the pressure oil is supplied to a rod-side chamber 5*b*.

The rotary blade is operated by a hydraulic motor 3 (optional attachment actuator) and rotates as the pressure oil is supplied to the hydraulic motor 3.

As shown in FIG. 1, the hydraulic circuit 1 of the present embodiment includes an arm-operating direction switching valve 7, a bucket-operating direction switching valve 8, an optional-attachment-operating direction switching valve 6, a distributing valve 9, and a flow rate control valve 10. The hydraulic circuit 1 is a circuit which is connected to a hydraulic pump 2, the arm cylinder 4 for moving the arm, the bucket cylinder 5 for moving the bucket, the hydraulic motor 3 for rotating the rotary blade, and a tank 13 to which the oil returns.

The optional-attachment-operating direction switching valve 6 is provided in a part of the unloading passage 21 which is on the upstream of the arm-operating direction switching valve 7 and the bucket-operating direction switching valve 8. The arm-operating direction switching valve 7 is provided in a part of the unloading passage 21 which is on the upstream of the bucket-operating direction switching valve 8. The arm-operating direction switching valve 7 may be provided in a part of the unloading passage 21 on the downstream of the bucket-operating direction switching valve 8.

The distributing valve 9 is provided in a part of the unloading passage 21 on the upstream of the optional-attachment-operating direction switching valve 6. The distributing valve 9 is preferably provided as an element constituting the hydraulic circuit of the present invention but is not an essential element.

A part of the unloading passage 21 on the upstream of the optional-attachment-operating direction switching valve 6 and the distributing valve 9 is connected, by a bypass passage 25, with a part of the unloading passage 21 between the optional-attachment-operating direction switching valve 6 and the arm-operating direction switching valve 7. On this bypass passage 25 is provided a flow rate control valve 10. Alternatively, the part of the unloading passage 21 on the upstream of the optional-attachment-operating direction switching valve 6 and the distributing valve 9 may be connected, by the bypass passage 25, with a part of the unloading passage 21 between the arm-operating direction switching valve 7 and the bucket-operating direction switching valve 8, and the flow rate control valve 10 may be provided on this bypass passage 25.

When the arm-operating direction switching valve 7 is provided in the part of the unloading passage 21 on the downstream of the bucket-operating direction switching valve 8, for example, the part of the unloading passage 21 on the upstream of the optional-attachment-operating direction switching valve 6 and the distributing valve 9 is connected, by the bypass passage 25, with a part of the unloading passage 21 between the optional-attachment-operating direction switching valve 6 and the bucket-operating direction switching valve 8, and the flow rate control valve 10 is provided on this bypass passage 25. Alternatively, the part of the unloading passage 21 on the upstream of the optional-attachment-operating direction switching valve 6 and the distributing valve 9 may be connected, by the bypass passage 25, with the part of the unloading passage 21 between the bucket-operating direction switching valve 8 and the arm-operating direction switching valve 7, and the flow rate control valve 10 may be provided on this bypass passage 25. The bypass passage 25 and the flow rate control valve 10 are preferably provided as elements constituting the hydraulic circuit of the present invention, but are not essential elements.

<Arm-Operating Direction Switching Valve>

The arm-operating direction switching valve 7 is a three-position direction switching valve configured to supply or exhaust, to or from the arm cylinder 4, pressure oil from the exhaust hydraulic pump 2. To this arm-operating direction switching valve 7, pressure oil is supplied from a pressure oil supply passage 23 (arm-operating pressure oil supply passage) which branches from the part of the unloading passage 21 between the optional-attachment-operating direction switching valve 6 and the arm-operating direction switching valve 7.

<Bucket-Operating Direction Switching Valve>

The bucket-operating direction switching valve 8 is a three-position direction switching valve which is configured to supply or exhaust, to or from the bucket cylinder 5, pressure oil from the hydraulic pump 2. To this bucket-operating direction switching valve 8, pressure oil is supplied from a pressure oil supply passage 24 (bucket-operating pressure oil supply passage) which branches from the part of the unloading passage 21 between the arm-operating direction switching valve 7 and the bucket-operating direction switching valve 8.

<Optional-Attachment-Operating Direction Switching Valve>

The optional-attachment-operating direction switching valve 6 is a three-position direction switching valve which is configured to supply or exhaust, to or from the hydraulic motor 3, pressure oil from the hydraulic pump 2. To this optional-attachment-operating direction switching valve 6, pressure oil is supplied from a pressure oil supply passage 22 (optional attachment pressure oil supply passage) which branches, via the distributing valve 9, from the part of the unloading passage 21 on the upstream of the optional-attachment-operating direction switching valve 6. When the distributing valve 9 is not provided, the pressure oil supply passage 22 (optional attachment pressure oil supply passage) directly branches from the part of the unloading passage 21 on the upstream of the optional-attachment-operating direction switching valve 6.

<Distributing Valve>

The distributing valve 9 is a three-position valve which is configured to change the flow distribution between the pressure oil flowing in the unloading passage 21 and the pressure oil flowing in the pressure oil supply passage 22, in accordance with the load pressure on the hydraulic motor 3. To one of two chambers of the distributing valve 9 (i.e., a chamber on the position 9*c* side), the pressure of the pressure oil supply passage 22 heading for the hydraulic motor 3 (i.e., the pump pressure of the hydraulic pump 2 and the hydraulic pressure between the distributing valve 9 and the optional-attachment-operating direction switching valve 6) is input.

To the other one of the chambers of the distributing valve 9 (i.e., a chamber on the position 9*a* side), the pressure of a tank passage 25 is input when the optional-attachment-operating direction switching valve 6 is at the position 6*b* (neutral position) (see FIG. 1). In the other one of the chambers of the distributing valve 9 (i.e., a changer on the position 9*a* side), a spring 26 is provided.

As shown in FIG. 3, when the optional-attachment-operating direction switching valve 6 is at the position 6*a* or the position 6*c* (full stroke position), the load pressure of the hydraulic motor 3 is input to the other one of the chambers of the distributing valve 9 (i.e., a changer on the position 9*a* side). Furthermore, as shown in FIG. 2, also when the optional-attachment-operating direction switching valve 6 is at the middle stroke region 6*x* or 6*y*, the load pressure of the hydraulic motor 3 is input to the other one of the chambers of the distributing valve 9 (i.e., a chamber on the position 9*a* side).

<Flow Rate Control Valve>

The flow rate control valve 10 is a valve configured to allow a predetermined amount of pressure oil to flow in the bypass passage 25. This flow rate control valve 10 is constituted by a variable throttle 11 provided on the bypass passage 25 and a bypass valve 12 which receives the pressures on the upstream and downstream of the variable throttle 11 and keeps the difference between the pressures on the upstream and downstream of the variable throttle 11 to be constant. To one of two chambers of the bypass valve 12 (i.e., a chamber on the position 12*b* side), the pressure on the upstream of the variable throttle 11 in the bypass passage 25 is input. To the other one of the chambers of the bypass valve 12 (i.e., a chamber on the position 12*a* side), the pressure on the downstream of the variable throttle 11 is input. In the other chamber of the bypass valve 12 (i.e., a chamber on the position 12*a* side), a spring 27 is provided.

(Operation of Hydraulic Circuit (Effects))

(Case Where Optional-Attachment-Operating Direction Switching Valve 6 is at Neutral Position (Position 6*b*))

The operation of the hydraulic circuit 1 will be described. Assume that the operator does not operate the hydraulic motor 3 which is configured to rotate the rotary blade, i.e., the operator does not operate the optional-attachment-operating direction switching valve 6. In this case, the optional-attachment-operating direction switching valve 6 is at the neutral position (position 6*b*) (see FIG. 1). Because the difference between the hydraulic pressures in the one chamber (on the position 9*c* side) and the other chamber (on the position 9*a* side) of the distributing valve 9 is higher than the spring force of the spring 26, the distributing valve 9 is moved to the position 9*c*. For this reason, pressure oil from the hydraulic pump 2 flows in the unloading passage 21.

(Case Where Optional-Attachment-Operating Direction Switching Valve 6 is at Middle Stroke Region 6*x* or 6*y*)

Assume that the operator simultaneously operates the arm cylinder 4 for moving the arm and the hydraulic motor for rotating the rotary blade, i.e., simultaneously operates the arm-operating direction switching valve 7 and the optional-attachment-operating direction switching valve 6. In this connection, assume further that the optional-attachment-operating direction switching valve 6 is not at the full stroke position but, as shown in FIG. 2, at the middle stroke region 6*x* (or 6*y*) (see FIG. 2). In this case, because the optional-attachment-operating direction switching valve 6 is provided in a part of the unloading passage 21 on the upstream of the arm-operating direction switching valve 7, the pressure oil is more likely to flow into the optional-attachment-operating direction switching valve 6 than to flow into the arm-operating direction switching valve 7. On this account, the operation of the optional-attachment-operating direction switching valve 6 is preferred to the operation of the arm-operating direction switching valve 7. This improves the operability of the rotary blade attached to the loader. It is noted that the same effect is achieved when the operator simultaneously operates the bucket cylinder 5 and the hydraulic motor 3. (The same holds true for the case where the optional-attachment-operating direction switching valve 6 is at the full stroke position).

In regard to the above, the distributing valve 9 is balanced at a position where the difference between the pressure in the pressure oil supply passage 22 (i.e., the pump pressure of the hydraulic pump 2 and the hydraulic pressure between the distributing valve 9 and the optional-attachment-operating direction switching valve 6) and the load pressure of the hydraulic motor 3 (i.e., the pressure on the downstream of the throttle 28 of the optional-attachment-operating direction switching valve 6) is equal to the spring force of the spring 26 (i.e., a position between the positions 9*a*, 9*b*, and 9*c*).

<Case Where Load Pressure of Hydraulic Motor 3 Becomes High>

The pressure in the chamber on the position 9*a* side of the distributing valve 9 becomes high and hence the distributing valve 9 moves to the position 9*a* side. Because the distributing valve 9 moves in a direction in which the area of the passage toward the unloading passage 21 is decreased, the pressure in the pressure oil supply passage 22 (i.e., the pump pressure of the hydraulic pump and the hydraulic pressure between the distributing valve 9 and the optional-attachment-operating direction switching valve 6) increases. The distributing valve 9 is balanced at a position where the difference between the hydraulic pressures applied to one and the other chambers of the distributing valve 9 (i.e., chambers on the position 9*c* side and on the position 9*a* side) is equal to the spring force of the spring 26.

<Case Where Load Pressure of Hydraulic Motor 3 Becomes Low>

The pressure in the chamber of the distributing valve 9 on the position 9*a* side becomes low, and hence the distributing valve 9 moves to the position 9*c* side. Because the distributing valve 9 moves in a direction in which the area of the passage toward the unloading passage 21 is increased, the pressure in the pressure oil supply passage 22 (i.e., the pump pressure of the hydraulic pump and the hydraulic pressure between the distributing valve 9 and the optional-attachment-operating direction switching valve 6) decreases. The distributing valve 9 is balanced at a position where the difference between the hydraulic pressures applied to one and the other chambers of the distributing valve 9 (chambers on the position 9*c* side and on the position 9*a* side) is equal to the spring force of the spring 26.

As such, as the difference between the pressures on the upstream and downstream of the throttle 28 of the optional-attachment-operating direction switching valve 6 is always kept constant by the distributing valve 9, the pressure oil is supplied to the hydraulic motor 3 at a constant flow rate (the flow distribution between the pressure oil flowing in the unloading passage 21 and the pressure oil flowing in the pressure oil supply passage 22 is changed), even if the load pressure of the hydraulic motor 3 changes (i.e., in accordance with the load pressure of the hydraulic motor 3).

The throttle 28 is formed in such a way that the passage of the pressure oil is tightened on account of the presence of the optional-attachment-operating direction switching valve 6 at the middle stroke region 6*x*.

(Case Where Optional-Attachment-Operating Direction Switching Valve 6 is at Full Stroke Position (Position 6*a* or 6*c*))

Assume that the operator sets the optional-attachment-operating direction switching valve 6 at the full stroke position (see FIG. 3). In this regard, the present embodiment assumes that the aperture area on the meter-in side of the optional-attachment-operating direction switching valve 6 at the full stroke position (position 6*a*) is not tightened. In this case, the difference between the pressures before and after the pressure oil passes the optional-attachment-operating direction switching valve 6 is smaller than the cracking force of the spring 26 of the distributing valve 9. The distributing valve 9 therefore takes the position 9*a* and the pressure oil no longer flows into a part of the unloading passage 21 on the downstream of the distributing valve 9. All of the pressure oil from the hydraulic pump flows into the optional-attachment-operating direction switching valve 6.

When the aperture area on the meter-in side of the optional-attachment-operating direction switching valve 6 at the full stroke position (position 6*a*) is tightened (i.e., a throttle is provided), the distributing valve 9 operates in the same way as in the case where the optional-attachment-operating direction switching valve 6 is at the middle stroke region 6*x* (see FIG. 2). (The same holds true for the full stroke position (position 6*c*)).

<Effect of Distributing Valve>

Because the distributing valve 9 is provided in the hydraulic circuit 1, the pressure oil supplied from the hydraulic pump 2 flows into the hydraulic motor 3 at a constant flow rate in accordance with the degree of opening of the optional-attachment-operating direction switching valve 6, irrespective of a change in the load pressure on the hydraulic motor 3, and the pressure oil flows into the arm cylinder 4 or the bucket cylinder 5 at a predetermined flow rate at least.

<Effects of Flow Rate Control Valve>

In addition to the above, in the present embodiment the hydraulic circuit 1 is provided with the bypass passage 25 and the flow rate control valve 10 which have been described above. Assume that the operator simultaneously operates the arm-operating direction switching valve 7 and the optional-attachment-operating direction switching valve 6. Assume further that the load pressure on the arm cylinder 4 is changed. In this case, even if the load pressure on the arm cylinder 4 is changed, redundant oil returns from the unloading passage 21 to the tank 13, because the difference between the pressures on the upstream and downstream of the variable throttle 11 provided on the bypass passage 25 is kept at constant by the bypass valve 12. To put it differently, because the bypass passage 25 and the flow rate control valve 10 are provided in the hydraulic circuit 1, the pressure oil supplied from the hydraulic pump 2 flows into the arm cylinder 4 at a constant flow rate in accordance with the degree of opening of the arm-operating direction switching valve 7, irrespective of a change in the load pressure on the arm cylinder 4. It is noted that the same effect is achieved when the operator simultaneously operates the bucket cylinder 5 and the hydraulic motor 3.

In addition to the above, because the throttle is arranged to be variable (variable throttle 11), the balance of the amount of the pressure oil supplied to the arm cylinder 4 (or the bucket cylinder 5), when the arm cylinder 4 (or the bucket cylinder 5) and the hydraulic motor 3 are simultaneously operated is changeable at will.

What is claimed is:

1. A hydraulic circuit for a loader, comprising:

an unloading passage connected to a hydraulic pump;

an arm-operating direction switching valve configured to supply to or exhaust from an arm actuator, pressure oil from the hydraulic pump;

a bucket-operating direction switching valve configured to supply to or exhaust from a bucket actuator, the pressure oil from the hydraulic pump; and an optional-attachment-operating direction switching valve configured to supply to or exhaust from an attachment actuator configured to actuate an optional attachment, the pressure oil from the hydraulic pump, wherein, the optional-attachment-operating direction switching valve is provided in a part of the unloading passage on the upstream of the arm-operating direction switching valve and the bucket-operating direction switching valve, the optional-attachment-operating direction switching valve receives the pressure oil from an optional-attachment-operating pressure oil supply passage which branches from a part of the unloading passage on the upstream of the optional-attachment-operating direction switching valve, the arm-operating direction switching valve receives the pressure oil from an arm-operating pressure oil supply passage which branches from a part of the unloading passage between the optional-attachment-operating direction switching valve and the arm-operating direction switching valve, the bucket-operating direction switching valve receives the pressure oil from a bucket-operating pressure oil supply passage which branches from a part of the unloading passage between the optional-attachment-operating direction switching valve and the bucket-operating direction switching valve, a bypass passage is provided to connect the part of the unloading passage on the upstream of the optional-attachment-operating direction switching valve with either the part of the unloading passage between the optional-attachment-operating direction switching valve and the arm-operating direction switching valve or the part of the unloading passage between the optional-attachment-operating direction switching valve and the bucket-operating direction switching valve, and a flow rate control valve which allows a predetermined flow rate of the pressure oil to flow in the bypass passage is provided in the bypass passage.

2. The hydraulic circuit according to claim 1, wherein, a distributing valve is provided in the part of the unloading passage on the upstream of the optional-attachment-operating direction switching valve, and the distributing valve is configured to change flow distribution between the pressure oil flowing in the unloading passage and the pressure oil flowing in the optional-attachment-operating pressure oil supply passage, in accordance with a load pressure of the attachment actuator.

3. The hydraulic circuit according to claim 2, wherein, the flow rate control valve includes:

a variable throttle provided in the bypass passage; and a bypass valve to which pressures on the upstream and the downstream of the variable throttle are input and which is configured to keep the pressures on the upstream and the downstream of the variable throttle to be constant.

4. The hydraulic circuit according to claim 1, wherein, the flow rate control valve includes:

a variable throttle provided in the bypass passage; and a bypass valve to which pressures on the upstream and the downstream of the variable throttle are input and which is configured to keep the pressures on the upstream and the downstream of the variable throttle to be constant.

* * * * *